US005407143A

United States Patent [19]

Nakai et al.

[11] Patent Number: 5,407,143

[45] Date of Patent: Apr. 18, 1995

[54] TURRET TYPE YARN WINDER

[75] Inventors: Shoji Nakai, Osaka; Tamotsu Kawamura, Takarazuka, both of Japan

[73] Assignee: Kamitsu Seisakusho Ltd., Hyogo, Japan

[21] Appl. No.: 24,937

[22] Filed: Mar. 2, 1993

[30] Foreign Application Priority Data

Mar. 2, 1992 [JP] Japan ..... 4-044897

[51] Int. Cl.[6] ..... B65H 67/048; B65H 54/42

[52] U.S. Cl. ..... 242/18 A; 242/18 R; 242/35.5 T; 242/410; 242/547

[58] Field of Search ..... 242/18 A, 18 DD, 18 R, 242/56 A, 65, 66, 547, 410, 35.5 T

[56] References Cited

U.S. PATENT DOCUMENTS

| | | | |
|---|---|---|---|
| 4,106,710 | 8/1978 | Schippers et al. | 242/18 R |
| 5,029,762 | 7/1991 | Behrens et al. | 242/18 A |
| 5,100,072 | 3/1992 | Behrens et al. | 242/18 A |
| 5,163,631 | 11/1992 | Borer | 242/18 DD |
| 5,228,630 | 7/1993 | Nakai et al. | 242/18 A |

FOREIGN PATENT DOCUMENTS 2255468 10/1990 Japan .

*Primary Examiner*—Daniel P. Stodola
*Assistant Examiner*—William Stryjewski
*Attorney, Agent, or Firm*—Burgess, Ryan & Wayne

[57] ABSTRACT

In a turret type yarn winder, a contact pressure acting on a roller bail by a yarn package is detected and used for controlling the rotation of a turret disc in accordance with the development of yarn layers on a bobbin so that the contact pressure is maintained at a predetermined value. A roller bail (5) detects a pressure acting thereon from a yarn package by a contact pressure sensor (7). If the detected contact pressure is higher than a target value, the turret disc (1) is driven in the direction to reduce the contact pressure. A driving torque of a motor (11) for driving the turret disc (1) is controlled in the normal/reverse direction by a signal corresponding to a deviation between the detected contact pressure and the target value so that the detected contact pressure coincides with the target value.

9 Claims, 7 Drawing Sheets

TURRET TYPE YARN WINDER

BACKGROUND OF THE INVENTION

1. Field of the Invention

The present invention relates to an apparatus for controlling a rotation of a turret disc in a turret type yarn winder based on the detected contact pressure between a yarn package and a roller bail.

2. Description of the Related Arts

A yarn winder has been already disclosed in Japanese Unexamined Patent Publication (Kokai) No. 2-255468, in which a displacement of a roller bail supported by an arm to be in contact with a yarn package is detected by a proximity switch and a turret disc is positively made to rotate in a normal direction based on the detected signal so that an increase of a package diameter is absorbed thereby, while adjusting a contact pressure onto the yarn package, i.e., a pressing force of the roller bail against the yarn package by the adjustment of a spring stiffness.

According to the above turret type yarn winder of the prior art, since the positional control of the roller bail based on the rotation of the turret disc and the adjustment of a contact pressure are carried out independently from each other, it is necessary to vary a spring stiffness and determine conditions by detecting loads (contact pressures) applied thereby on the roller bail at the respective positions at which the control is carried out, whereby a prompt and accurate adjustment is difficult. Particularly, when a plurality of turret type winders are densely arranged in multiple stairs and rows, the contact pressure adjustment is very complicated because it is necessary to determine the contact pressure of the respective winder by the individual mechanical adjustment.

SUMMARY OF THE INVENTION

An object of the present invention is to improve a contact pressure control in the prior art turret type yarn winder described above, and to provide a turret type yarn winder comprising a roller bail rotatably supported between a yarn traverse means and a bobbin at a winding position, while being in contact with a surface of a yarn package; a contact pressure detecting means connected with said support member directly or through a resilient member by a member for detecting a reaction from the yarn package received by the roller bail; and a motor driving circuit for positively rotating a motor in a direction so that the contact pressure between the bobbin at the winding position and the roller bail is reduced when the contact pressure detected by the contact pressure detecting means is larger than a predetermined target value of the contact pressure. In addition, the turret type yarn winder according to the present invention further comprises a control circuit for controlling a driving torque for rotating the turret disc in a normal/reverse direction by an output signal corresponding to a difference between the detected contact pressure and the target value so that the contact pressure is maintained at the target value, a correcting means for the target value, an adjusting means for a contact pressure level, and a suitable switching means for controlling and switching a turret disc driving motor.

DESCRIPTION OF THE DRAWINGS

The above and other objects and advantages of the present invention will be apparent in more detail with reference to the attached drawings illustrating the preferred embodiments; in which.

DETAILED DESCRIPTION OF THE PREFERRED EMBODIMENTS

Figure 1:
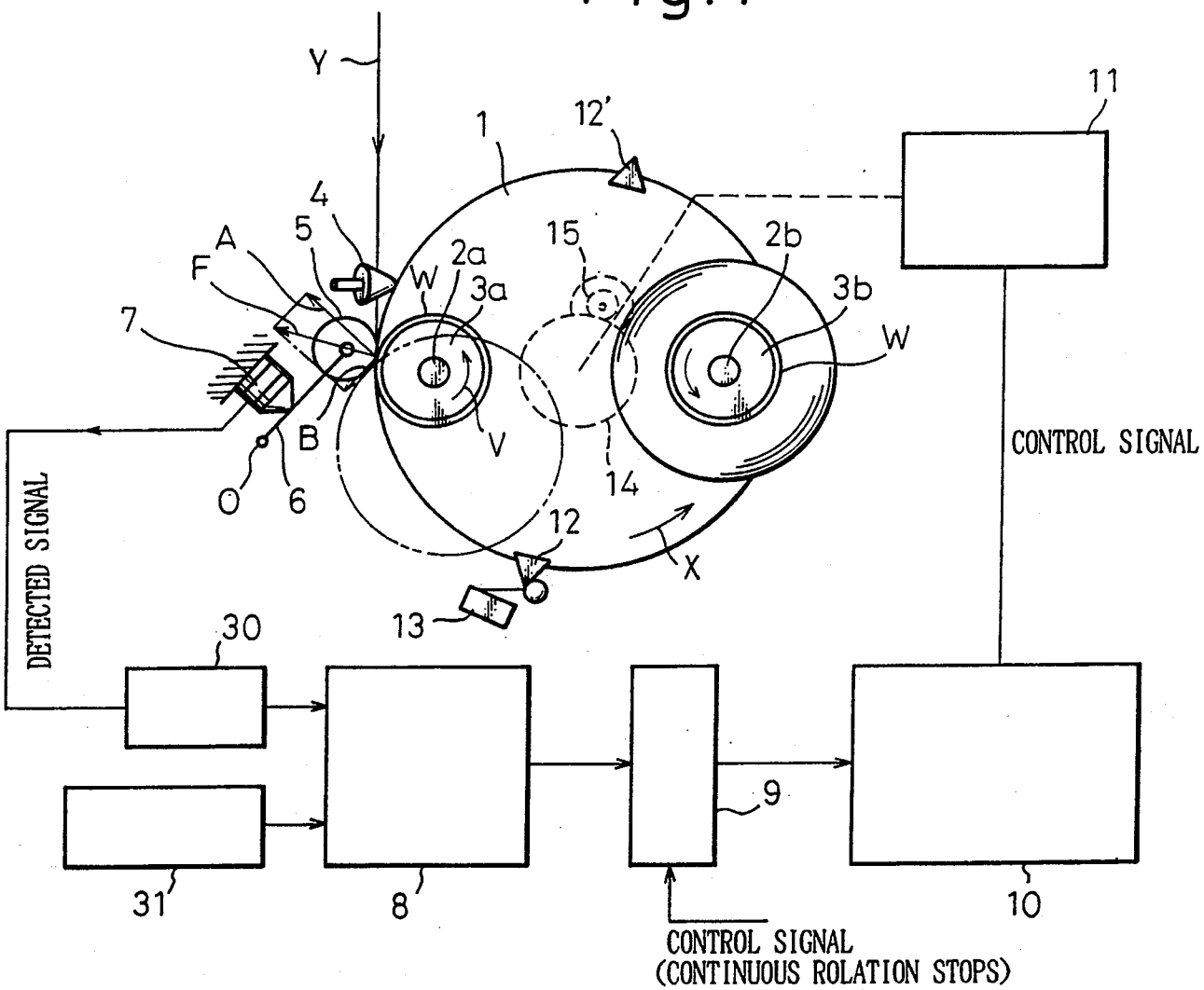
FIG. 1 is a diagram of an operational system illustrating an embodiment of a turret type yarn winder according to the present invention.
Figure 2:
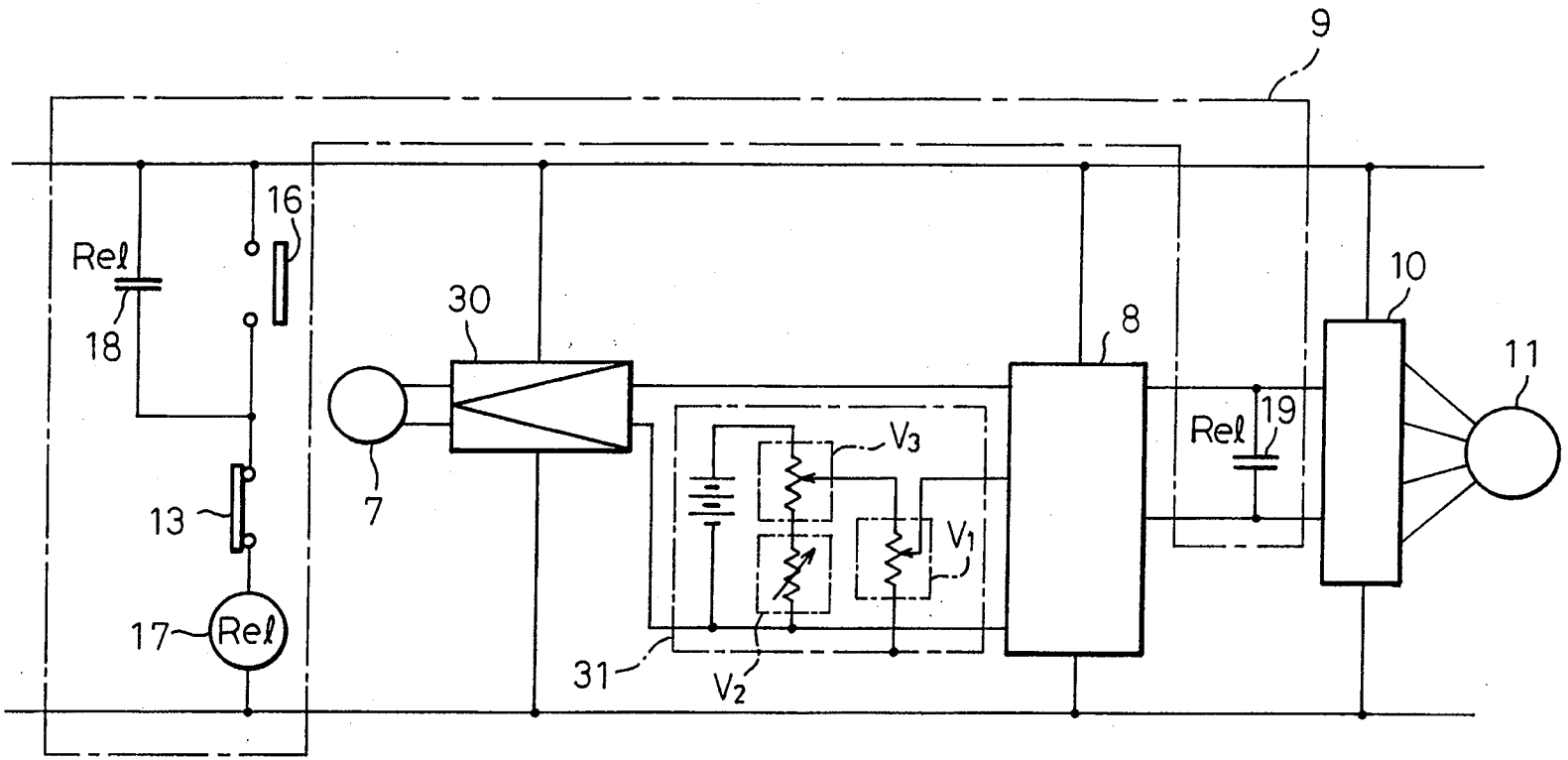
FIG. 2 shows a control circuit for a contact pressure of a roller bail.
Figure 7:
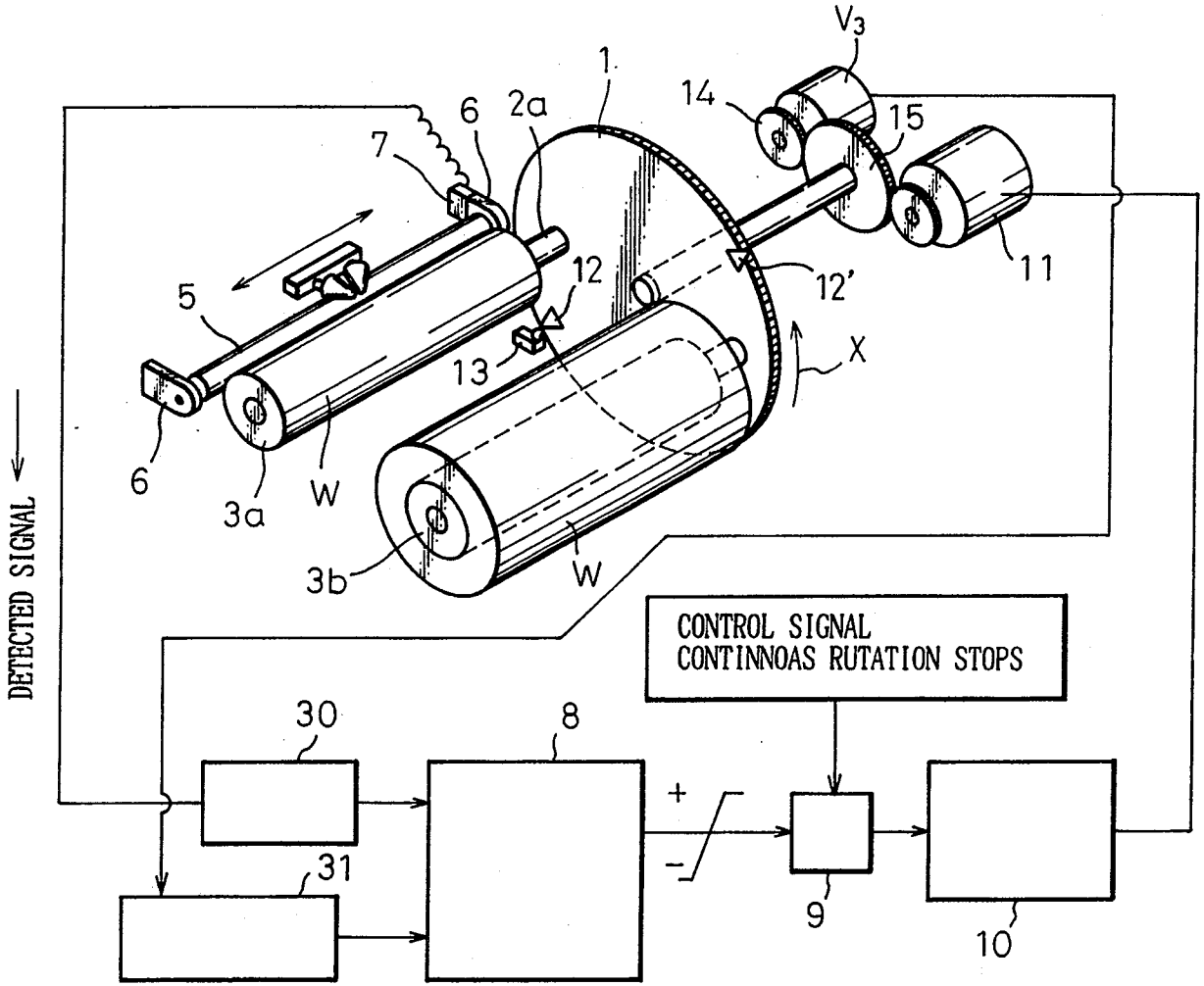
FIG. 7 is a diagram of an operational system illustrating another embodiment according to the present invention.
Figure 8:
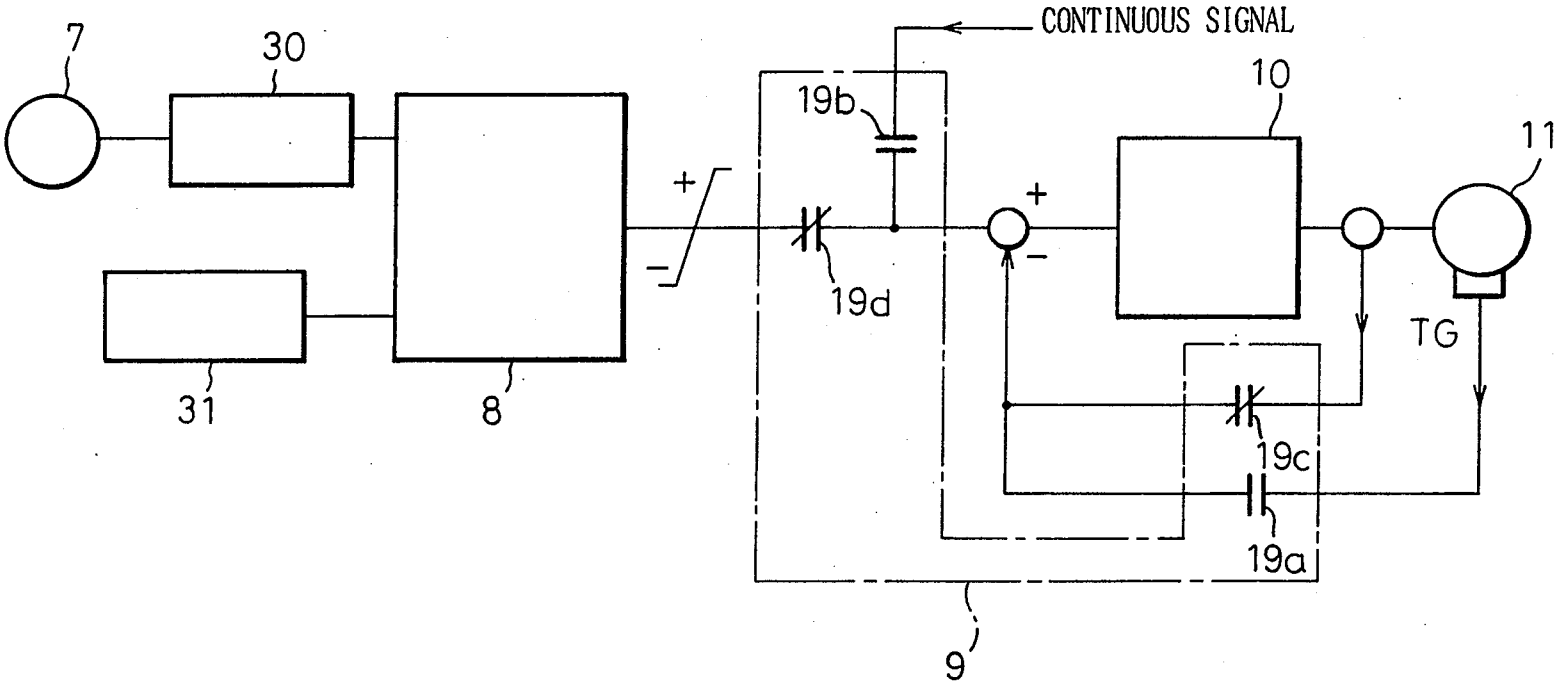
FIG. 8 shows a detailed circuit for controlling a motor in FIG. 7.

In the turret type yarn winder according to the present invention, as shown in FIGS. 1 and 2, a contact pressure detecting means 7 consisting of a pressure sensor such as a load cell connected with a support member 6 for rotatably supporting the roller bale 5 detects a reaction (contact pressure) on a roller bale 5 due to a contact with a yarn package and transmits the detected signal to a comparison circuit 8. If it is determined in the comparison circuit 8 that the detected contact pressure is higher than a predetermined target value of the contact pressure, its signal pulse is input to a driving circuit 11 of a motor 11 to drive the motor 11 to cause a small angular rotation in the direction so that the contact pressure between the roller bale 5 and a bobbin W is reduced. In addition, as shown in FIGS. 7 and 8, if it is determined in the comparison circuit 8 that the detected contact pressure is higher than the target value, the rotational direction and the driving torque of the motor 11 are controlled to reduce the detected contact pressure, and if it is determined that the detected contact pressure is lower than the target value, the rotational direction and the driving torque of the motor 11 are controlled to increase the detected contact pressure. As a result, the detected contact pressure coincides with the target value. In this regard, a contact pressure setting device $V_1$ and a potentiometer $V_3$ are provided in a contact pressure setting means B, for changing the target value and freely setting a contact pressure level and a contact pressure changing rate.

An embodiment of a turret type yarn winder according to the present invention will be described below with reference to FIG. 1

A pair of winding spindles 2*a*, 2*b* are provided on a turret disc 1 at diametrically symmetrical positions on a common circle. The respective spindle is rotatable in the arrowed direction V by a motor (not shown) and has a bobbin holder 3*a*, 3*b* carrying a bobbin W. In the drawing, one spindle 2*a* is positioned at a winding position at which a yarn guide 4 is provided while carried by a known traversing device for reciprocatedly displacing a yarn Y in the axial direction of the bobbin W. A roller bail 5 is provided beneath the yarn guide in parallel to the bobbin W.

The roller bail 5 is positioned to be in contact with the bobbin W occupying the winding position and rotatably supported at the opposite ends thereof via bearings on a support member 6 pivoted to a machine frame to be swingable around a pin 0. A pressure sensor such as a load cell 7 is provided as a contact pressure detecting means at a stationary position while confronting a midportion of the support member 6, for receiving a pressure when the roller bail 5 is in contact with the bobbin W.

The load cell 7 has a function to receive a stress component A; one of two components A and B of an actual stress F corresponding to a contact pressure acting on the roller bail 5 from the bobbin W when the stress F is divided into two components directed perpendicular to each other as shown in FIG. 1. The component A is minimum at the initial stage of the winding operation on the bobbin W and gradually increases to be equal to the stress F as the bobbin W approaches the full state.

A pressure signal (detected contact pressure) issued from the load cell 7 is amplified through an amplifier 30 and compared in a comparator 8 with a target value of the contact pressure preset by a contact pressure setting means 31 in accordance with winding conditions. Only when the detected contact pressure has become continuous during a predetermined period, e.g., 0.5 seconds, and higher than the target value due to the increment of yarn layers on the bobbin W by function of a timer circuit (not shown) is an ON signal transmitted from the comparator 8 to a motor driving circuit 10 through a switching means 9. Thereby a control pulse signal is transmitted from the motor driving circuit 10 to a step motor 11 connected with a turret disc 1 via a speed reduction gear mechanism such as a gear train (not shown) so that the step motor 11 is actuated to make one step rotation, by which the turret disc 1 makes a stepwise small angular rotation in a normal direction X. According to this stepwise angular rotation of the turret disk 1, the bobbin W also makes an orbital motion in the same direction, whereby a distance between axes of the bobbin W and the roller bail 5 substantially increases. Thus the contact pressure is reduced, that is, the increment of the yarn layer is absorbed.

Accordingly, while the angular position of the turret disk 1 is controlled so that the maximum value of the stress component A acting on the load cell 7 becomes constant if it is assumed that the target value of the contact pressure set in the contact pressure setting means 31 is invariable, the actual stress F (contact pressure) gradually decreases as the bobbin diameter increases because the component A increases as the bobbin W reaches the full state from the initial stage of the winding operation, whereby a bulging phenomenon of a package (package expansion on the side surface) can be avoided.

When the bobbin W reaches a predetermined diameter 10 as a result of continuous winding operation at the winding position, the switching means 9 is actuated by a full bobbin signal issued from a limit switch for detecting the rotating angle of the turret disc 1 or a yarn length counter provided in a yarn feeding path, by which the motor driving circuit 10 issues consecutive pulses to continuously rotate the motor 11. When a projection 12 or 12' fixed on the turret disc 1 abuts a limit switch 13 fixed on the machine frame, the continuous rotation of the turret disc 1 is made to stop, whereby a fresh empty bobbin replaces a full bobbin at a waiting position and is transferred to the winding position. While the orbital motion of the bobbin is stopping, a yarn Y is switched from the full bobbin to the fresh empty bobbin and then a new series of yarn winding operations is initiated on the empty bobbin.

Figure 3:
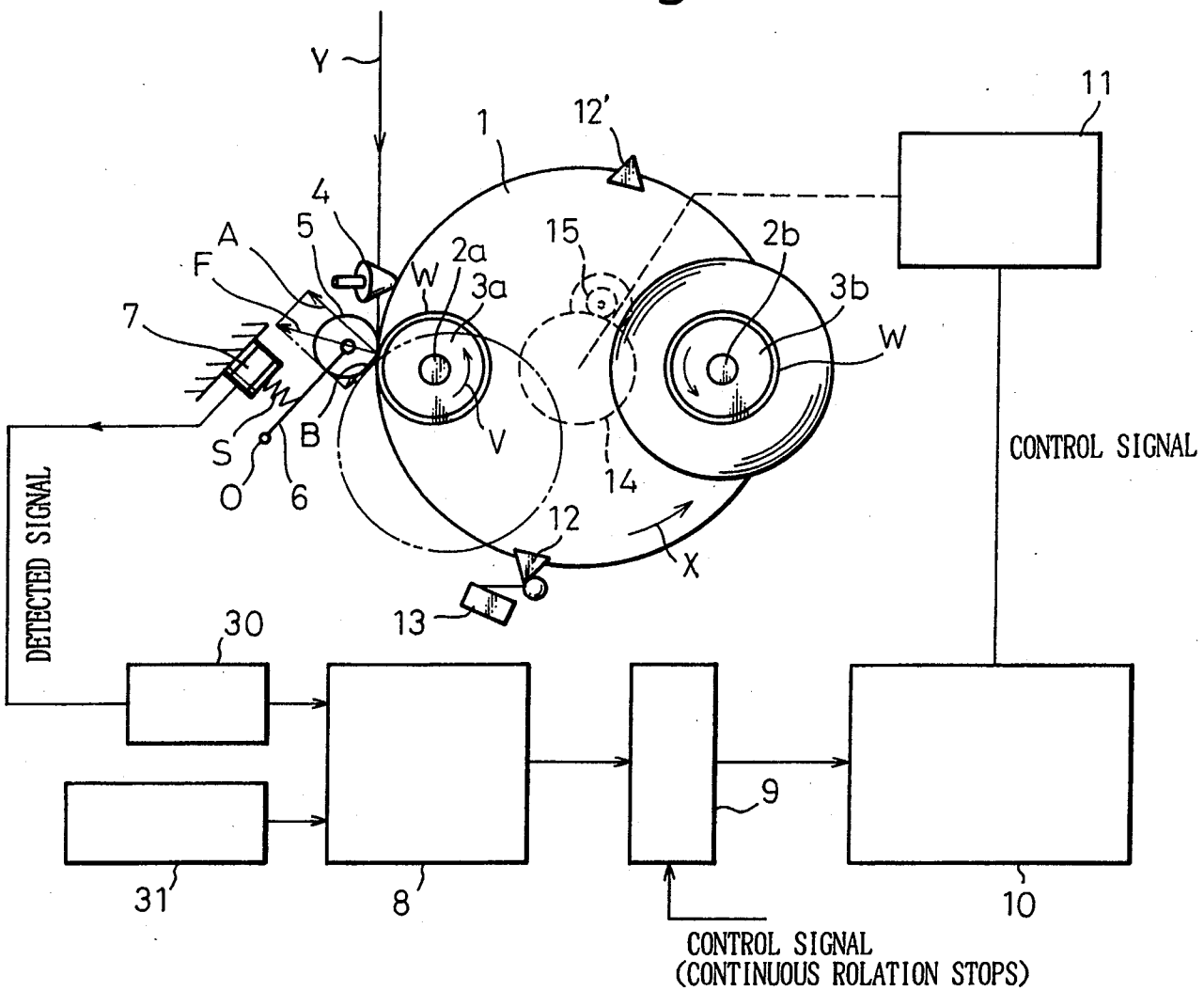
FIG. 3 is a diagram of an operational system illustrating another embodiment of a turret type yarn winder according to the present invention.

FIG. 1 shows a case where the load cell 7 is directly connected to the supporting member 6, but as shown in FIG. 3, the load cell 7 may be connected through a spring 5 to the supporting member. A stiffness of the spring S is necessarily set at a value at least equal to or higher than a detectable maximum pressure of the load cell 7. In addition, a strain within an adjustment range for a contact pressure is preferably as large as possible provided the yarn winding operation is not interfered with thereby. If the strain is excessive, the positional variation of the roller bail 5 is so large that a yarn may go out of the yarn guide 4 or a winding angle of a yarn to the roller bail 5 is unfavorably changed to a large extent.

Further, the step motor 11 has a braking force overcoming a minus load caused by a contact pressure. Accordingly it is possible to obstruct a free rotation of the turret disk 1. If another motor, i.e., a motor having no a self-retaining force is used in place of the step motor, a unidirectional transmission mechanism such as a worm gear may be arranged between the motor and the turret disc, or the turret disc may be provided with a mechanism for applying a braking force which can obstruct the free rotation of the turret disc 1 caused by the contact pressure.

The above embodiment has a function for freely adjusting a contact pressure variation (contact pressure level and variation rate thereof) in accordance with the increment of the yarn layers on the bobbin during the yarn winding operation.

That is, as shown in FIG. 2, a circuit in the contact pressure setting means 31 includes a potentiometer $V_l$ for setting levels of contact pressure, another potentiometer $V_2$ for setting a variation rate of contact pressure and a potentiometer $V_3$ for detecting a rotational phase of the turret disc 1.

The potentiometer $V_3$ is preferably of a continuous 360° rotation type, associated with the turret disc 1 via gears 14, 15 so that it accurately rotates twice as the turret disc 1 rotates once in the same manner as shown FIG. 7.

Accordingly, the potentiometer $V_3$ has a resistance value that varies from the initial stage to the final stage of the yarn winding operation so that an output from the comparator 8 can be changed.

Next, the variation of contact pressure in the actual yarn winding operation will be described with reference to FIG. 4(*a*) and 4(*b*).

Figure 4A:
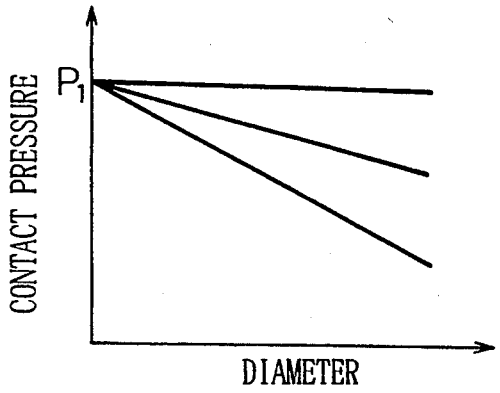
FIGS. 4(*a*) and 4(*b*) are graphs showing a variation of a contact pressure, respectively.
Figure 4B:
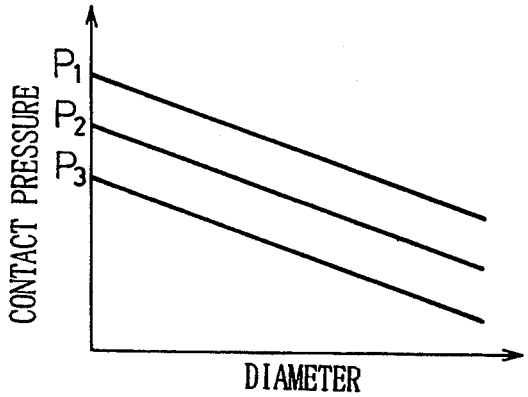

If a target value $P_1$ of the contact pressure is set by the potentiometer $V_1$ and then the potentiometer $V_2$ is adjusted to three levels, the contact pressure varies as shown in FIG. 4(*a*). On the other hand, if the potentiometer $V_1$ is adjusted to three levels; $P_1$, $P_2$, and $P_3$, the contact pressure varies as shown in FIG. 4(*b*).

In this regard, it is possible to combine a circuit with $V_1$, $V_2$ and $V_3$, for varying a signal transmitted from the load cell 7 through the amplifier 30 by $V_1$, $V_2$ and $V_3$, while the target value $P_1$ is kept constant.

In FIG. 2, a switch 16 is provided for continuously revolving the turret disc 1 when the positions of the full bobbin and the empty bobbin are replaced with each other, which operation is actuated when the bobbin is filled during the yarn winding operation. Other elements are built into the circuit of FIG. 2; a self-hold relay 17, a self-hold contact 18 and a contact 19 closed when the relay 17 is energized.

When the switch 16 is actuated at the time the bobbin becomes full, the relay 17 is energized to close the contacts 18, 19, whereby the relay is in a self-holding state. As the contact 19 is in a closed stage, the motor 11 makes a continuous rotation to revolve the turret disc 1 by a predetermined angle, by which the fixed point limit switch 13 is opened to deenergized the relay 17, then both the contacts 18, 19 are opened to stop motor 11. Thus the turret disc 1 stops at a predetermined position.

Figure 5A:
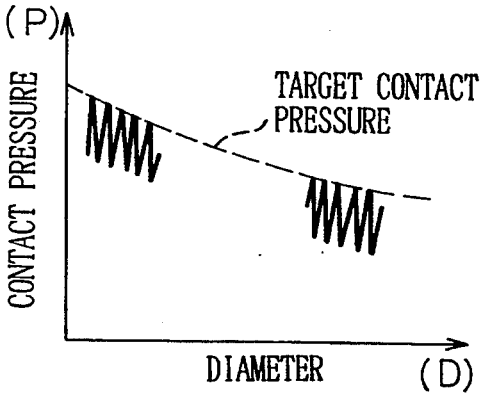
FIGS. 5(*a*) and 5(*b*) are graphs showing a relationship between a winding diameter of package and a contact pressure, respectively.
Figure 5B:
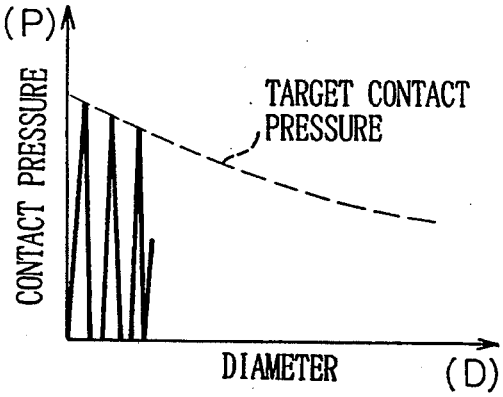

FIGS. 5(*a*) and 5(*b*) shows graphs illustrating a relationship between the bobbin diameter and the contact pressure when the turret disc 1 is stepwisely rotated while the contact pressure is consecutively detected, in which 5(*a*) is a case when the contact pressure is adjusted in such a manner that the angle of the stepwise rotation of the turret disc 1 is set at a very small value so that an amount of bobbin displacement per one step orbital motion is kept within an elastic strain of the spring S shown in FIG. 3, and 5(*b*) is a case when the angle of the stepwise rotation is set at a somewhat larger value or the spring S is not used between the supporting member 6 and the load cell 7, in which the contact pressure P once descends to a zero level by one stepwise rotation of the turret disc 1 and then gradually elevates to a target value, those steps being repeated, whereby regular contact pressure is applied to the package surface by the roller bail 5 so that a package having a regular shape is obtained.

Figure 6:
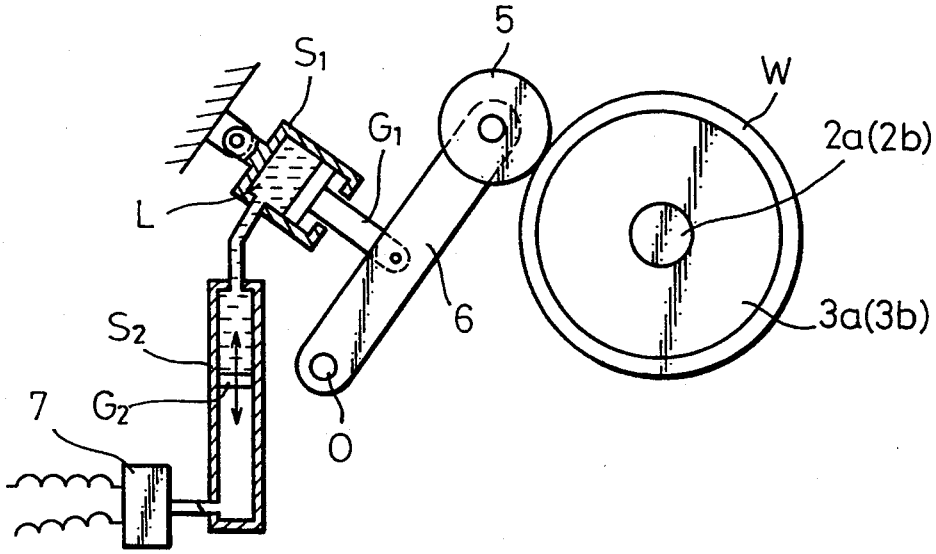
FIG. 6 is a side view of another embodiment of a contact pressure detecting means.

FIG. 6 shows another embodiment of a contact pressure detecting means 7 used in the present invention, in which a tip end of a piston rod $G_1$ of a large diameter cylinder $S_1$ mounted on the machine frame is connected with a midportion of the support member 6 of the roller bail 5 shown in FIG. 1. A chamber of the large diameter cylinder $G_1$ filled with non-compressive fluid such as water or oil is communicated with a chamber of a small diameter cylinder $S_2$. The small diameter cylinder $S_2$ is provided with a pressure sensor 7 for detecting the inner pressure of an air chamber partitioned by a piston $G_2$ of the small cylinder $S_2$. When the roller bail 5 is pressed by the increased yarn layers on the bobbin W, a fluid in the large diameter cylinder $S_1$ pushes down the piston $G_2$ of the small diameter cylinder $S_2$ to pressurize air therein. The pressure sensor 7 detects the elevation of the inner pressure. The air charged in the small diameter cylinder $S_2$ acts as a kind of air spring.

FIGS. 7 and 8 show an embodiment of means for controlling a driving torque in the normal/reverse direction of the turret disc 1, in which the same reference numerals denote the same elements as illustrated in FIGS. 1 and 2. A load cell 7 has no elastic member so that a force applied to a roller bail 5 is directly measured. A detected signal (actual contact pressure) issued from the load cell 7 is compared with a target value of contact pressure in a comparator 8, a difference of which is transmitted therefrom as a deviation signal to a motor driving circuit 10 through a switching means 9.

In this regard, the motor 11 used in this embodiment is of such a type that the driving torque in the normal/reverse direction can be controlled in proportion to the difference signal and a rotational number can be controlled when the turret disc 1 is continuously rotated.

That is, the motor 11 has a tacho-generator TG and, as described in relation to FIG. 2, in the bobbin transfer operation, contacts 19*a*, 19*b* are closed and contacts 19*c*, 19*d* are opened by the action of a relay of the switching means 9 so that the motor 11 continuously rotates to revolve the turret disc 1 by a continuous rotation signal transmitted thereto under feedback-control by a feedback voltage in proportion to the rotation from the tacho-generator.

While not shown in FIG. 8, during the above-described bobbin transfer operation, when the waiting empty bobbin has been moved to a winding position and stopped at a predetermined point, a yarn switching operation is carried out in a non-contact state with some distance between the bobbin W and the roller bail 5. Thereafter, the motor 11 is continuously energized for a short period set by a timer not shown to revolve the turret disc 1 to an angular position where a center of the empty bobbin W slightly exceeds in the normal direction a line connecting the respective centers of the roller bail 5 and the turret disc 1 with each other. At this position, a substantial yarn winding onto the empty bobbin is initiated. Accordingly, if it is adapted that the relay contacts 19*a*, 19*b*, 19*c* and 19*d* in the circuit in FIG. 7 are respectively switched when yarn layers wound on the empty bobbin W have increased to a certain diameter and the load cell 7 has detected a contact pressure, an unexpected reverse rotation of the turret disc 1 can be avoided. Further, since it is possible to subject the empty bobbin W to an orbital motion for obtaining the winding position during the bobbin transfer operation without interference with the roller bail 5, there is no need to provide a retreating device for a roller bail but the roller bail 5 can be installed at a fixed position.

In this regard, a method for preventing the turret disc 1 from unexpected reverse rotation at the initial stage of the winding operation is not limited to the above one, but the reverse rotation of the turret disc 1 may be avoided by the use of any mechanical means such as a ratchet mechanism when the empty bobbin W reaches a proper initial winding position.

During the yarn winding operation, when the contacts 19*a*, 19*b* are opened and the contacts 19*c*, 19*d* are closed by the relay action of the switching means 9, the comparator 8 issues a difference signal by which a voltage applied to the motor 11 is controlled in a feedback manner to adjust a driving torque of the motor 11. When the measured contact pressure detected by the load cell 7 is higher than the target value, a driving torque in the normal direction is imparted to the motor 11 by a plus signal from the comparator 8 whereby the turret disc 1 revolves in the normal direction X so that the contact pressure acting on the roller bail 5 is lowered. On the contrary, when the measured contact pressure is lower than the target value, a driving torque in the reverse direction is imparted to the motor 11 in accordance with a minus signal from the comparator 8 whereby the contact pressure between the bobbin W and the roller bail 5 is restored at the target value. Thus, the variation of the contact pressure due to an unbalance between weights of the full bobbin and the bobbin currently being formed can be corrected.

Figure 9A:
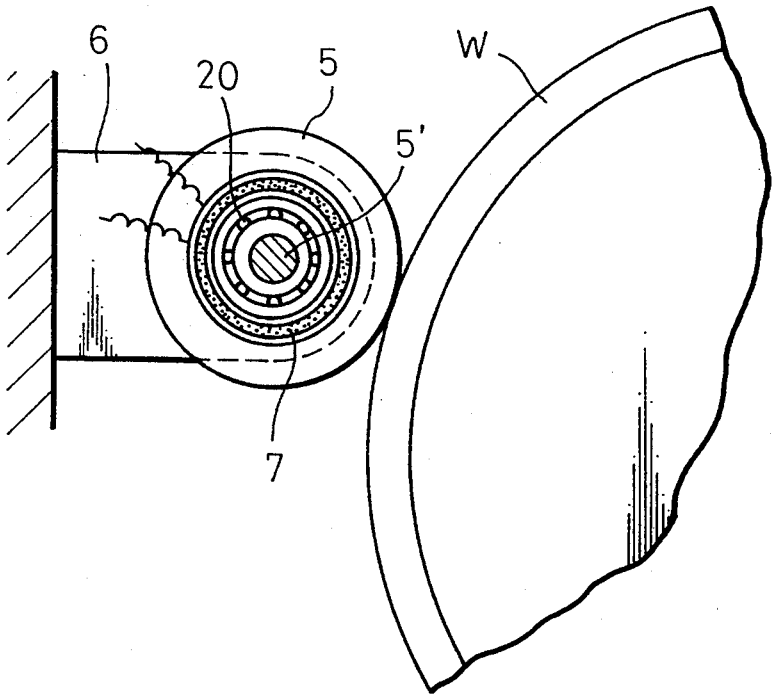
FIGS. 9(*a*) and 9(*b*) are a side view and a partial enlarged view, respectively, of another embodiment of a pressure sensor as a contact pressure detecting means.
Figure 9B:
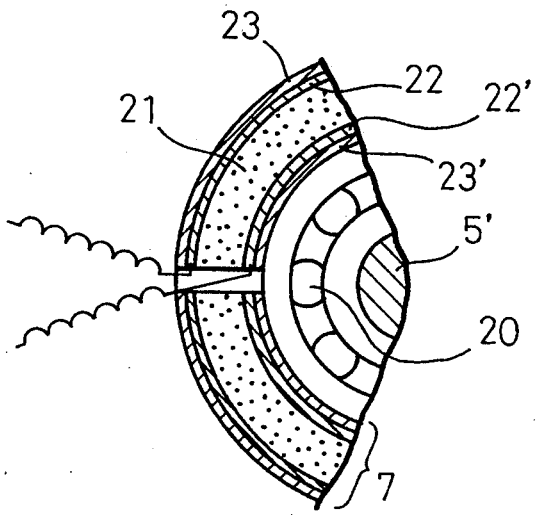

FIGS. 9(*a*) and 9(*b*) illustrate another embodiment of a pressure sensor used as a contact pressure detecting means for measuring a pressure acting on the roller bail 5, in which an axis 5' of the roller bail 5 is supported by a support member 6 while penetrating the same, together with a bearing 20 and a pressure sensor 7 fixed on an outer race of the bearing 20. The pressure sensor 7 is formed by a tape-like pressure sensitive element 21 of a rubber containing special metallic powders, electrode plates 22, 22' adhered on the respective sides of the pressure sensitive element 21 and insulating plates 23, 23' each attached on the outer surface of the electrode plate, which elements are bent together in a ring shape. The pressure sensitive element 21 has a function in that an electric resistance thereof changes by the compression thereof so that the force acting on the roller bail 5 is detected as an increase/decrease of the resistance value and is issued as an output signal. According to this pressure sensor 7, a contact pressure received from the yarn package can be directly detected thereby, irrespective of a rotational phase of the turret disc 1, i.e., a position of the bobbin W. On the contrary, in the former embodiment, only one pressure component is detected and used as a contact pressure value.

According to the present invention, a stress acting on the roller bail from the yarn package can be directly detected by a contact pressure detecting means, and by using this detected value the turret disc is positively and stepwisely revolved by a small angle in a direction to reduce the detected contact pressure. Further the turret disc is revolved by a driving torque modified in accordance with the detected contact pressure so that the contact pressure acting on the roller bail is controlled to coincide with a target value optionally preset.

Since the target value set in the contact pressure detecting means can be easily changed through a remote control by an electric means, it is possible to concentratedly control contact pressures in a plurality of spindles. When the target value set in the contact pressure detecting means is changed in accordance with angular positions of the turret disc varying with the increment of the package diameter, it is also possible to optionally change an inclination of a characteristic curve of the contact pressure on the roller bail. When combined with means for adjusting a contact pressure level, it is possible to optionally vary an inclination of the characteristic curve of the contact pressure as well as a contact pressure level.

We claim:

1. A turret yarn winder for winding a yarn comprising:

(a) a roller bale;

(b) a supporting member for rotatably supporting the roller bale, the supporting member having an axis of rotation spaced from the roller bale about which the support member rotates;

(c) a turret disc having a central axis about which the turret disc rotates and means for rotating the turret disc, the turret disc being rotatable between a first position where a bobbin mounting on a first spindle is in face to face contact with the roller bale, and a second position where a bobbin mounting on a second spindle is in face to face contact with the roller bale so that a yarn is wound on the bobbin on the first spindle to build a package while the second spindle is spaced from the roller bale, to permit a full package to be removed and an empty bobbin to be mounted on the second spindle;

(d) at least the first spindle and the second spindle are rotatably mounted on the turret disc on a common circumference about the axis of the disc, each spindle having means for mounting a bobbin thereon and means for rotating the spindle;

(e) a yarn traverse mechanism located on a side of the roller bale away from the bobbin for transversely reciprocating the yarn during winding on the bobbin to build a yarn package;

(f) means for detecting when the yarn package being wound on the bobbin in contact with the roller bale is full;

(g) means for rotating the turret disc between the first position and the second position when the yarn package in contact with the roller bale is full so that the empty bobbin mounted on the second spindle contacts the roller bale;

(h) means acting on the supporting member for generating a contact pressure of the roller bale with the bobbin during the package winding;

(i) a contact pressure detecting means associated directly with the supporting member of the roller bale for detecting the contact pressure of the roller bale with the package building on the bobbin and providing a signal representative of the contact pressure; and (j) a turret disc control means which responds to the contact pressure signal for controlling a position of rotation of the turret to maintain a required contact pressure of the roller bale with respect to the package building on the bobbin.

2. The turret yarn winder of claim 1 wherein the turret disc control means comprises a comparator for comparing the signal representative of the contact pressure with a target value, a motor means for rotating the turret disc in a direction to adjust the contact pressure between the winding bobbin and the roller bale and a motor control means for causing the motor to rotate the turret disc to obtain the target pressure value.

3. The yarn winder of claim 2, wherein the motor control means comprises a target value adjusting means for varying the target value to be compared with the contact pressure signal from the contact pressure detecting means, in accordance with a rotational displacement of the turret disc, the displacement required to maintain the target value of the contact pressure during the yarn winding operation.

4. The yarn winder of claim 2, wherein the motor control means comprises a contact pressure level adjusting means for adjusting a level of the detected contact pressure signal from the contact pressure detecting means, or a level of the target value to be compared with the contact pressure signal.

5. The turret yarn winder of claim 1, wherein the contact pressure detecting means is connected with the support member through a resilient member.

6. The yarn winder of claim 1, wherein the turret disc control means comprises as motor means for rotating the turret disc, connected with the turret disc, the driving torque of the motor means being controllable in a direction of rotation of the turret disc, a comparator for comparing the contact pressure signal from the contact pressure detecting means with a predetermined target signal value, and a motor control circuit for imparting the driving torque of the motor to the turret disc in a direction to increase the contact pressure of the bale when the detected contact pressure signal indicates that the contact pressure is lowered than the target pressure value and for imparting the driving torque to the motor in a direction to reduce the contact pressure of the bale when the detected contact pressure signal indicates that the contact pressure is higher than the target pressure value, so that the contact pressure Is maintained at the target pressure value.

7. The yarn winder of claim 6, wherein the motor control circuit comprises a contact pressure adjusting means for varying the detected contact pressure signal from the contact pressure detecting means or for varying the target value to be compared with the contact pressure signal in accordance with a rotational position of the turret disc during the yarn winding operation.

8. The yarn winder of claim 6, wherein the motor control means comprises a contact pressure level adjusting means for adjusting a level of the signal representative of the detected contact pressure or a level of the target value to be compared with the contact pressure signal.

9. The yarn winder of claim 6 wherein the motor control circuit controls the motor means for driving the turret disc by feedback control of a voltage applied to the motor so that the driving torque is adjustable during the yarn winding operation and also controls the motor means by a feedback control of rotation in accordance with a signal from a tacho-generator during the bobbin transfer operation.

* * * * *